US011685486B2

(12) United States Patent
Khodr

(10) Patent No.: US 11,685,486 B2
(45) Date of Patent: Jun. 27, 2023

(54) RESILIENT BUMPER AND BUMPER SYSTEM

(71) Applicant: Saudi Arabian Oil Company, Dhahran (SA)

(72) Inventor: Rabih A. Khodr, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 214 days.

(21) Appl. No.: 17/149,183

(22) Filed: Jan. 14, 2021

(65) Prior Publication Data

US 2022/0219793 A1 Jul. 14, 2022

(51) Int. Cl.
*B63B 59/00* (2006.01)

(52) U.S. Cl.
CPC ..... *B63B 59/00* (2013.01)

(58) Field of Classification Search
CPC . B63B 59/00; B63B 59/02; E02B 3/26; E02B 3/24; E02B 3/28; B60G 11/113
USPC ..... 267/193
See application file for complete search history.

(56) References Cited

U.S. PATENT DOCUMENTS

| | | | | |
|---|---|---|---|---|
| 2,953,904 | A | 9/1960 | Christenson | |
| 3,138,932 | A | 6/1964 | Kofahl et al. | |
| 3,191,388 | A | 6/1965 | Ludwig | |
| 3,277,653 | A | 10/1966 | Foster | |
| 3,294,051 | A | 12/1966 | Khelstovsky | |
| 3,389,562 | A | 6/1968 | Mott et al. | |
| 3,515,259 | A | 6/1970 | Before | |
| 3,535,884 | A | 10/1970 | Chaney | |
| 3,572,044 | A | 3/1971 | Pogonowski | |
| 3,575,005 | A | 4/1971 | Sumner | |
| 3,610,193 | A | 10/1971 | Lacy et al. | |
| 3,624,702 | A | 11/1971 | Meheen | |
| 3,797,256 | A | 3/1974 | Giblon | |
| 3,917,306 | A * | 11/1975 | Madler | B60G 21/04 280/124.109 |
| 4,000,624 | A | 1/1977 | Chow | |
| 4,040,256 | A | 8/1977 | Bosche et al. | |

(Continued)

FOREIGN PATENT DOCUMENTS

| | | |
|---|---|---|
| DE | 2457536 | 6/1976 |
| JP | 2016514779 | 5/2016 |

(Continued)

OTHER PUBLICATIONS

RWTH Aachen University, Institute of Structural Mechanics and Lightweight Design, (https://www.sla.rwth-aachen.de/... titut-fuer-Strukturmechanik-und-Leichtbau/Forschung/Projekte/~sguh/Sensorintegration-in-eine-Blattfeder/?lidx=1) "Sensor Integrated Leaf Spring" Jan. 2, 2019, retrieved Oct. 7, 2022 (Year: 2019).*

(Continued)

*Primary Examiner* — Anthony D Wiest
(74) *Attorney, Agent, or Firm* — Fish & Richardson P.C.

(57) ABSTRACT

The present disclosure describes a resilient bumper that comprises an arc-shaped spring member that extends from a first end to a second end along a spring axis and includes an impact surface arranged between the first and second ends; and a support member that includes an attachment interface that extends in parallel to the spring axis of the spring member and is configured to releasably engage the first and second ends of the spring member. A bumper system and a marine structure are also described.

17 Claims, 9 Drawing Sheets

(56) References Cited

U.S. PATENT DOCUMENTS

| | | | | |
|---|---|---|---|---|
| 4,117,691 | A | 10/1978 | Spray | |
| 4,155,671 | A | 5/1979 | Vos | |
| 4,156,577 | A | 5/1979 | McMakin | |
| 4,161,376 | A | 7/1979 | Armstrong | |
| 4,227,831 | A | 10/1980 | Evans | |
| 4,271,412 | A | 6/1981 | Glass et al. | |
| 4,307,876 | A | 12/1981 | Cleaves | |
| 4,397,478 | A * | 8/1983 | Jensen | B60G 11/465 267/31 |
| 4,451,174 | A | 5/1984 | Wetmore | |
| 4,497,593 | A | 2/1985 | Kramer | |
| 4,534,678 | A | 8/1985 | Nakazato et al. | |
| 4,607,586 | A | 8/1986 | Taquino | |
| 4,662,791 | A | 5/1987 | Spicer | |
| 4,666,341 | A | 5/1987 | Field et al. | |
| 4,711,601 | A | 12/1987 | Grosman | |
| 4,804,205 | A * | 2/1989 | Parsons | B60G 5/03 180/378 |
| 4,983,074 | A | 1/1991 | Carruba | |
| 5,188,484 | A | 2/1993 | White | |
| 6,273,441 | B1 * | 8/2001 | Neavitt | F16F 1/26 267/48 |
| 6,612,781 | B1 | 9/2003 | Jackson | |
| 6,832,970 | B2 | 12/2004 | Eibler | |
| 6,948,440 | B2 | 9/2005 | Aschenbach | |
| 2002/0154954 | A1 | 10/2002 | Huang et al. | |
| 2005/0084336 | A1 | 4/2005 | Xu et al. | |
| 2006/0275080 | A1 | 12/2006 | Li et al. | |
| 2007/0090623 | A1 * | 4/2007 | Preijert | B60G 11/12 267/260 |
| 2009/0191002 | A1 | 7/2009 | Stubler et al. | |
| 2010/0024705 | A1 | 2/2010 | Leverette | |
| 2010/0150660 | A1 | 6/2010 | Nadarajah et al. | |
| 2011/0158750 | A1 | 6/2011 | Reichel et al. | |
| 2011/0305523 | A1 | 12/2011 | Karal et al. | |
| 2012/0216737 | A1 | 8/2012 | Luo et al. | |
| 2013/0092069 | A1 | 4/2013 | Xie et al. | |
| 2013/0298815 | A1 | 11/2013 | Bussemaker et al. | |
| 2014/0308080 | A1 | 10/2014 | Youman et al. | |

FOREIGN PATENT DOCUMENTS

| | | |
|---|---|---|
| JP | S 58153219 | 7/2016 |
| WO | WO 2010085970 | 8/2010 |
| WO | WO 2015170098 | 11/2015 |

OTHER PUBLICATIONS trelleborg.com [online] "Marine Fenders," available on or before Oct. 11, 2020, retrieved on Apr. 2, 2021, retrieved from URL <https://www.trelleborg.com/en/marine-and-infrastructure/products-solutions-and-services/marine/marine-fenders>.

wikipedia.com [online] "Leaf Spring," available on or before Jun. 30, 2018, via Internet Archive: WayBack Machine URL <http://web.archive.org/web/20180630232738/https://en.wikipedia.org/wiki/Leaf_spring>, retrieved on Apr. 2, 2021 <https://en.wikipedia.org/wiki/Leaf_spring>.

* cited by examiner

RESILIENT BUMPER AND BUMPER SYSTEM

TECHNICAL FIELD

This specification relates to resilient bumpers and bumper systems.

BACKGROUND

Bumpers are used to absorb shock and prevent damage when two objects collide. In some cases, the bumper is mounted to a moving object. In other cases, the bumper is mounted to a stationary object. A bumper system can include multiple individual bumpers, for example, attached to a structure, such as a pier or a building. On impact, the bumper deforms to absorb a portion of the impact energy. In some cases, this deformation is substantially irreversible, for example, for car bumpers. In contrast, resilient bumpers return substantially to their original state and are designed for repeated impact.

SUMMARY

In general, this disclosure relates to a resilient bumper and bumper systems.

In one aspect, a resilient bumper includes an arc-shaped spring member that extends from a first end to a second end along a spring axis and includes an impact surface arranged between the first and second ends; and a support member that includes an attachment interface that extends in parallel to the spring axis of the spring member and is configured to releasably engage the first and second ends of the spring member.

Implementations may include one or more of the following features.

In some implementations, at least one of the first and second ends of the spring member are moveably mounted to the attachment interface, wherein a deflection of the spring member increases a distance between the first and second ends of the spring member along the spring axis.

In some implementations, the spring member includes a leaf spring including a spring steel, a fiber-reinforced material, a resin, a composite material, or a combination thereof. For example, the spring member can include a stacked leaf spring that includes a stack of arc-shaped spring leaves and one or more clamps to clamp the stack of spring leaves. In some implementations, each spring leaf includes a spring steel, a fiber-reinforced material, a resin, a composite material, or a combination thereof. In some implementations, the stacked leaf spring further including a flat bumper plate that forms the impact surface, wherein the clamp presses the bumper plate against the stack of spring leaves.

In some implementations, the first end of the spring member includes a first pair of rollers rotatably mounted to the first end of the spring member, and the second end of the spring member includes a second pair of rollers rotatably mounted to the second end of the spring member, wherein the first and second pair of rollers are configured to roll along a surface of the support member as the first and second ends move along the attachment interface.

In some implementations, the first end of the spring member includes a first sliding pin and the second end of the spring member includes a second sliding pin, the attachment interface includes a slot formed in a surface of the support member and configured to receive a shaft portion of each of the first and second sliding pins, and the first and second sliding pin each include a head portion connected to the shaft portion and having an outer diameter larger than a width of an opening of the slot.

In some implementations, the attachment interface includes one or more insertion openings that are sized to accommodate the head portion of the first and second sliding pins and communicate with the slot. In some implementations, the one or more insertion openings are offset laterally to the spring axis and connected to the slot by a respective connection portion.

In some implementations, the slot includes a first slot segment configured to receive the shaft portion of the first sliding pin and a second slot segment configured to receive the shaft portion of the second sliding pin, wherein the first and second slot segments are separate from one another.

In some implementations, the slot includes a hook portion that supports the first or the second sliding pin at a fixed vertical position along the spring axis.

In some implementations, the first and second pairs of rollers are received within the support member and configured to travel along an inner surface of the support member, wherein the attachment interface includes an opening through which the spring member extends.

In some implementations, the spring member includes a composite material and one or more optic fiber sensors embedded in the composite material, wherein the one or more optic fiber sensors are configured to detect the a load as the spring member deflects.

In some implementations, the support member includes one or more mounting holes for mounting the support member.

In another aspect, a bumper system includes a plurality of resilient bumpers, each resilient bumper including an arc-shaped spring member that extends from a first end to a second end along a spring axis and includes an impact surface arranged between the first and second ends, and a support member that includes an attachment interface that extends in parallel to the spring axis of the spring member and is configured to releasably engage the first and second ends of the spring member; and a frame to which the support member of each of the plurality of resilient bumpers is connected, such that the resilient bumpers are aligned along a frame axis substantially transverse to the spring axis of each resilient bumper.

Implementations may include one or more of the following features.

In some implementations, at least one of the first and second ends of the spring member are moveably mounted to the attachment interface, wherein a deflection of the spring member increases a distance between the first and second ends of the spring member along the spring axis.

In some implementations, the bumper system includes a load panel that extends along the frame axis and covers the resilient bumpers, wherein each of the spring members of the plurality of resilient bumpers includes a flat bumper configured to engage the load panel.

In some implementations, each of the spring members includes a composite material and one or more optic fiber sensors embedded in the composite material, wherein the one or more optic fiber sensors are configured to detect the a load as the spring member.

In a further aspect, a marine structure includes a plurality of resilient bumpers, each resilient bumper including an arc-shaped spring member that extends from a first end to a second end along a spring axis and includes an impact surface arranged between the first and second ends, and a support member that includes an attachment interface that extends in parallel to the spring axis of the spring member and is configured to releasably engage the first and second ends of the spring member; and a frame to which the support member of each of the plurality of resilient bumpers is connected, such that the resilient bumpers are aligned along a frame axis substantially transverse to the spring axis of each resilient bumper, wherein the frame is configured to rest on the seabed.

The details of one or more implementations of the subject matter described in this specification are set forth in the accompanying drawings and the detailed description. Other features, aspects, and advantages of the subject matter will become apparent from the description, the drawings, and the claims.

DETAILED DESCRIPTION

Figure 1A:
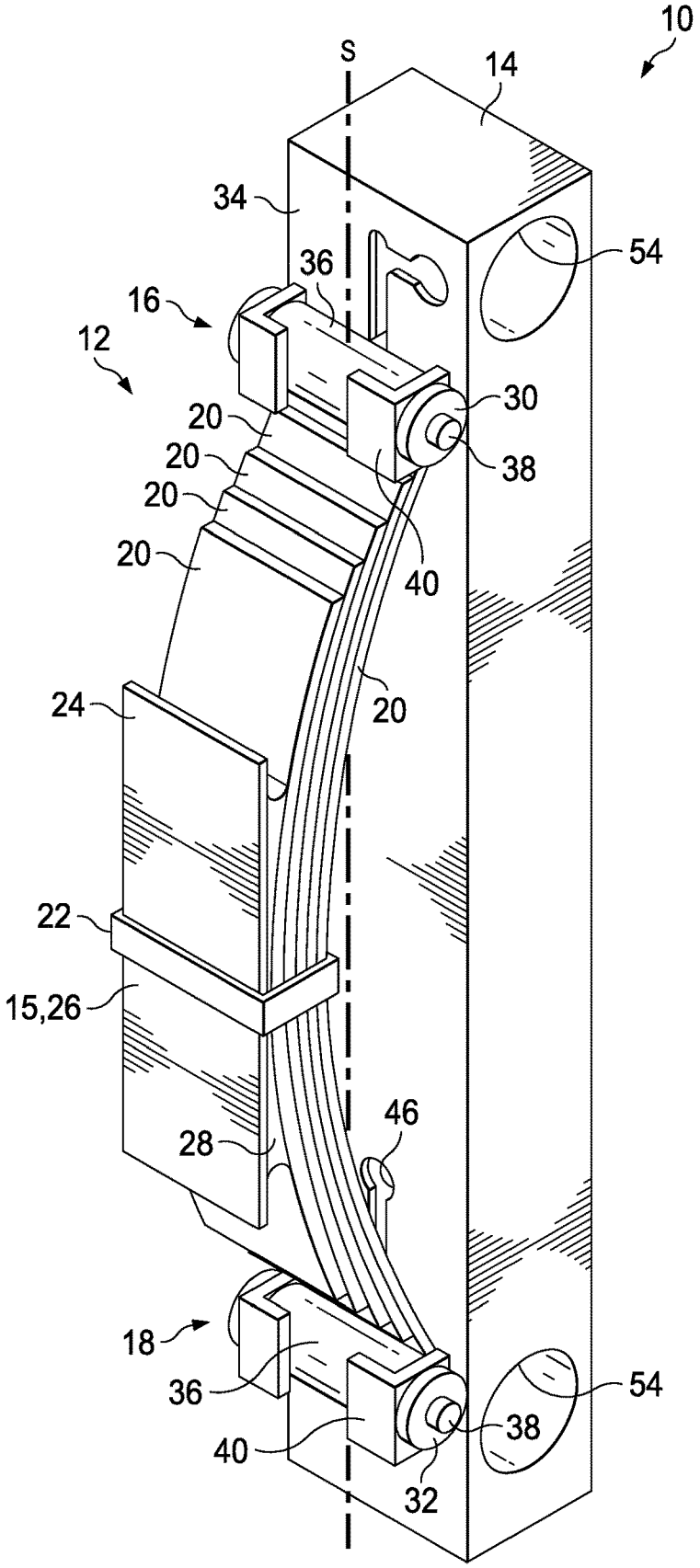
FIG. 1A shows a front perspective view of a resilient bumper according to one implementation.
Figure 1B:
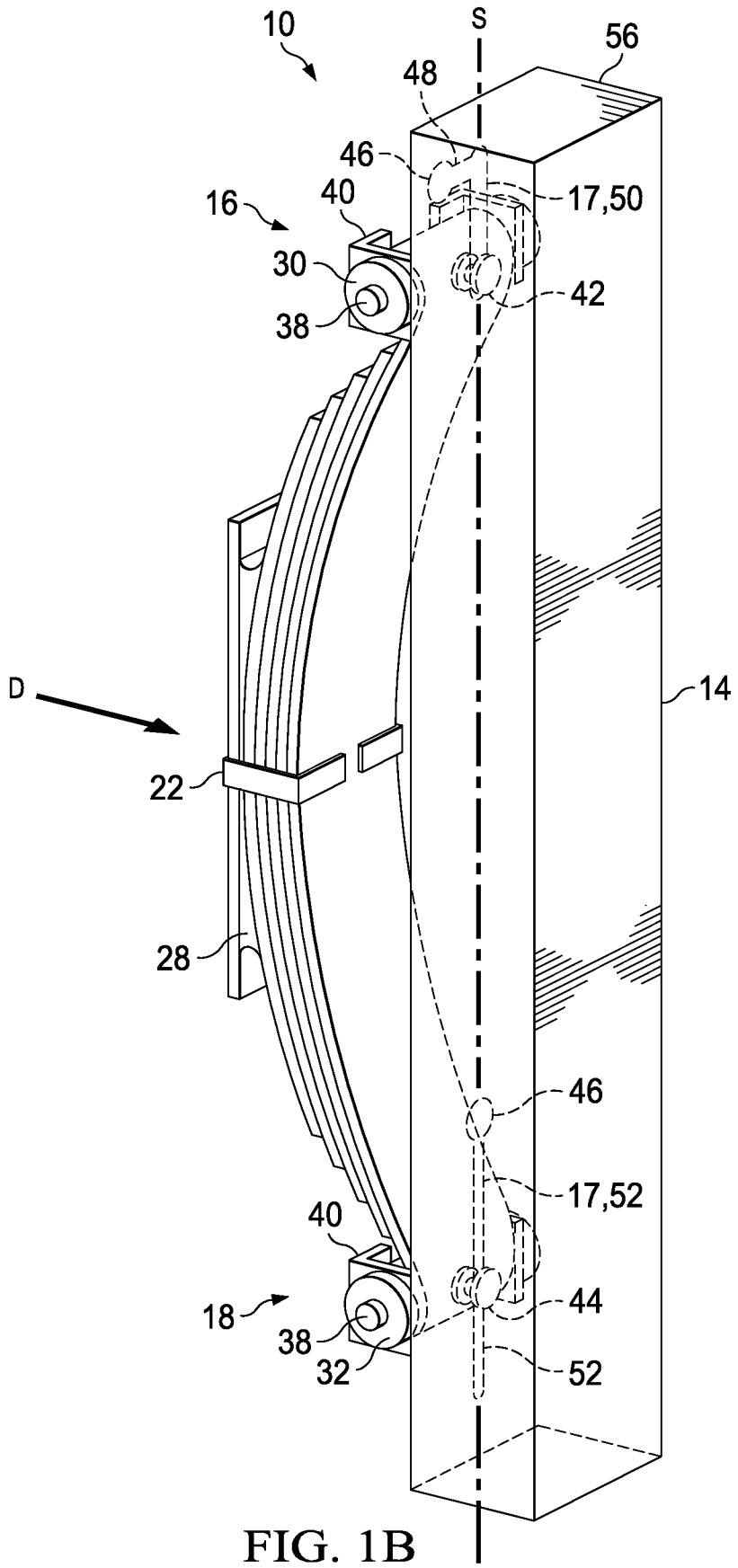
FIG. 1B shows a rear perspective view of the resilient bumper of FIG. 1A.

Referring to FIGS. 1A and 1B, an implementation of a resilient bumper 10 is shown. The resilient bumper 10 comprises a spring member 12 and a support member 14. The spring member 12 is arc-shaped and includes an impact surface 15 at a crown of the arc. The impact surface 15 is the surface that comes into contact with, i.e., bumps or is bumped into, an object external to the bumper and deflects the spring member 12. For example, the impact surface 15 can be equidistant to the spring member's first and second ends 16, 18. The spring member 12 extends along a spring axis S between a first end 16 and a second end 18. The support member 14 comprises an attachment interface or track 17 that extends in parallel to the spring axis S of the spring member 12 (FIG. 1B). The attachment interface is configured to releasably engage the first and second ends of the spring member to mount the spring member 12 to the support member 14. In FIGS. 1A and 1B, the first and second ends 16, 18 of the spring member 12 are moveably mounted to the track 17 of the support member 14 such that a deflection of the spring member transverse to the spring axis S moves the first and the second ends 16, 18 relative to the support member 14.

In some cases, the arc-shaped spring member 12 can comprise a leaf spring. A leaf spring is a curved strip of resilient material that is substantially longer than it is wide. In some cases, the arc-shaped spring member 12 includes a stacked leaf spring that comprises a stack of arc-shaped spring leaves 20 and one or more clamps 22 to clamp the stack of spring leaves 20. For example, friction between the individual spring leaves 20 can provide a damping action as an object collides against the spring member 12. Instead of the clamp 22, the spring member 12 can also comprise U-bolts that maintain friction among the stack of spring leaves 20.

As illustrated in FIGS. 1A and 1B, the leaves 20 of the stacked leaf spring become progressively shorter along the spring axis S. However, the stacked leaf spring can also include leaves that have substantially the same length. The illustrated stacked leaf spring includes five individual spring leaves 20. However, in other implementations, the number of leaves 20 can differ. As previously mentioned, the leaf spring can include a single leaf. Other implementations can include fewer or greater than five leaves depending on the forces to be absorbed by the bumper 10. In some implementations, all of the springs leaves 20 are made of the same material. Example materials for spring leaves include spring steel, a fiber-reinforced material, a resin, a composite material, or a combination thereof. The spring leaves 20 can be formed by 3D printing. In some cases, a stacked leaf spring can include spring leaves 20 made of different materials.

In addition to the curved spring leaves 20, some stacked leaf springs include a flat bumper plate 24 arranged on the topmost leaf 20. The bumper plate 24 includes an outer surface 26 that forms the bumper's impact surface 15. For example, if the bumper plate 24 and the spring leaves 20 are viewed from the side, the center line of the flat outer surface 26 and the respective spring leaves meet at the crown of the spring leaves 20. In some implementations, the bumper plate 24 can also include a curved inner surface that is shaped to mate with the curved spring leaves 20. Accordingly, the bumper plate 24 can include two wedge portions 28 that transition between the flat outer surface 26 and the curved inner surface. As illustrated, the length of the bumper plate 24 along the spring axis S amounts to roughly half of the length of the spring member 12. In some cases, the ratio of the length of the bumper plate 24 to the length of the spring member 12 can be greater or smaller, e.g., ⅓ or ⅔. Although the bumper plate 24 forms the impact surface 15 in the illustrated implementation, other implementations do not necessarily include a bumper plate 24. Instead, the impact surface can be formed by the outer surface of the topmost leaf 20 at the crown of the arc, for example.

The first end 16 of the spring member 12 can include a first pair of rollers 30 that are rotatably mounted to the first end 16 of the spring member 12. The second end 18 of the spring member 12 can include a second pair of rollers 32 that are rotatably mounted to the second end 18 of the spring member 12. The first and second pair of rollers 30, 32 are configured to roll along a surface 34 of the support member 14 as the first and second ends 16, 18 of the spring member 12 move with respect to the support member 14. In the illustrated implementation, the first and second pair of rollers 30, 32 roll along the top or outer surface 34 of the support member 14. For example, the spring member 12 can include a loop 36 at each end. A bolt 38 can extend through the loop, transverse to the spring axis. A spacer 40 and each of the rollers 30, 32 can be rotatably mounted on the bolt 38. The loop 36 can be formed integrally by one of the spring leaves 20. Instead of a common bolt 38, each roller can also be mounted by a separate bolt or pin.

In some implementations, the first and second ends 16, 18 of the spring member 12 are moveably mounted to a track 17 of the support member 14 to connect the spring member 12 and the support member 14. The support member's track 17 can have various configurations that engage the first and second ends 16, 18 of the spring member 12 in different ways. For example, the first end 16 of the spring member 12 can include a first sliding pin 42 and the second end 18 of the spring member 12 can include a second sliding pin 44 (FIG. 1B). The track 17 can comprise a slot formed in the surface 34 of the support member 14 that is configured to receive a shaft portion of each of the first and second sliding pins 42, 44. The first and second sliding pin 42, 44 can each comprise a head portion that is connected to the shaft portion and has an outer diameter larger than a width of an opening of the slot. The track 17 can also include one or more insertion openings 46 that are sized to accommodate the head portion of the first and second sliding pins 42, 44 and communicate with the slot. For example, the slot and the insertion openings 46 can form a keyhole shape. In some cases, the insertion opening 46 is directly connected to the slot and lies along the spring axis S, as shown at the bottom of FIG. 1B. Alternatively, the insertion opening 46 can be offset from the spring axis S and connected to the slot by a connection portion 48, as shown at the top of FIG. 1B. For example, an offset insertion opening 46 may prevent the spring member 12 from disconnecting from the support member 14.

In some cases, the slot can include a first slot segment 50 that receives the shaft portion of the first sliding pin 42 and a second slot segment 52 distinct from the first slot segment 50 that receives the shaft portion of the second sliding pin 44. In such cases, one of the slot segments 50, 52 can include a hook portion at one end that supports the first or the second sliding pin 42, 44 at a fixed vertical position along the spring axis S. In FIG. 1B, the first sliding pin 42 is located in the hook portion of the first slot segment 50 to hang the spring member 12 at its first end 16. Alternatively, the spring member 12 can be supported in a similar manner by its second end 18. Although the bumper 10 is illustrated with two slot segments 50, other implementations can include one continuous slot.

The bumper 10 of FIGS. 1A and 1B can be assembled by inserting the head portion second sliding pin 44 into the second slot segment's insertion opening 46. The spring member 12 is pivoted about the second sliding pin 42 so that the head portion of the first sliding pin 42 enters the first slot segment's insertion opening 46. The first sliding pin 42 is then moved along the connection portion 48 and into the first slot segment 50. Thus, the bumper 10 of FIGS. 1A and 1B can be easily assembled largely without the use of tools.

The assembled resilient bumper 10 can be mounted by the support member 14 to another structure and used to absorb shock and prevent damage to the structure, as explained in more detail in reference to FIGS. 5A, 5B, 6A, and 6B. For this purpose, the support member 14 can include one or more mounting holes 54 (FIG. 1A). An object that collides with the bumper 10 will generally make contact with the impact surface 15 formed, for example, by the bumper plate 24. The colliding object causes the spring member 12 to deflect inward towards the support member 14 in a direction transverse to the spring axis S, in the direction indicated by the arrow D in FIG. 1B.

In some implementations, the first and second ends 16, 18 of the spring member 12 are not fixed in place, and one or both ends 16, 18 can move in response to the deflection of the spring member 12. For example, referring to FIG. 1B, a collision may cause the second sliding pin 44 to move downward along the second slot segment 52 while the first sliding pin 42 remains in the hook portion illustrated in FIG. 1B. However, since the first sliding pin 42 is not fixedly attached to the first slot segment 50, a subsequent collision may cause the first sliding pin 42 to move upward along the first slot segment 50 while the second sliding pin 44 moves along the second slot segment 52. In both cases, since the first and second ends 16, 18 are moveably mounted to the support member 14, the deflection of the spring member 12 causes the first and second ends 18 to move apart and increase a distance between the first and second ends 16, 18 along the spring axis S. Since the illustrated bumper 10 allows the spring member 12 and its ends 16, 18 to move relative to the support member 14, the bumper 10 may be less prone to mechanical failure at the connection points between the spring member 12 and the support member 14 than, e.g., bolts or welded connections.

Figure 2C:
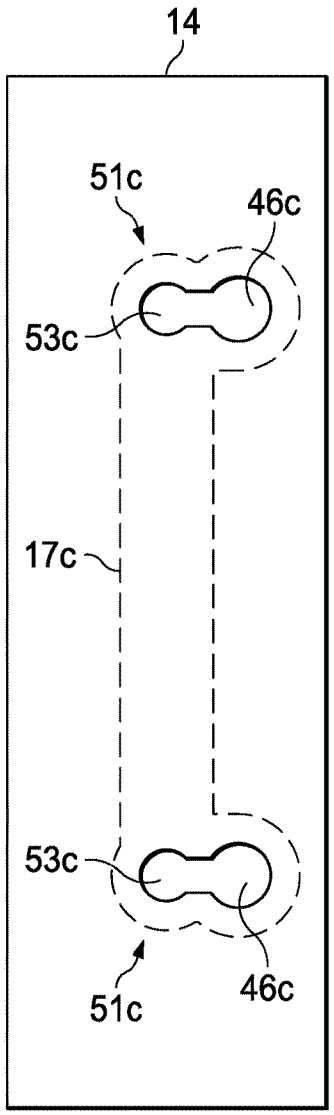
FIG. 2A to 2C shows a rear view of different attachment interfaces.
Figure 2B:
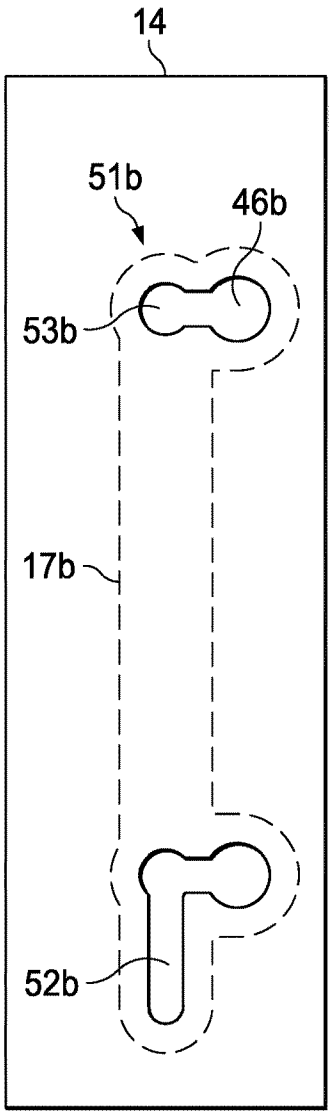
Figure 2A:
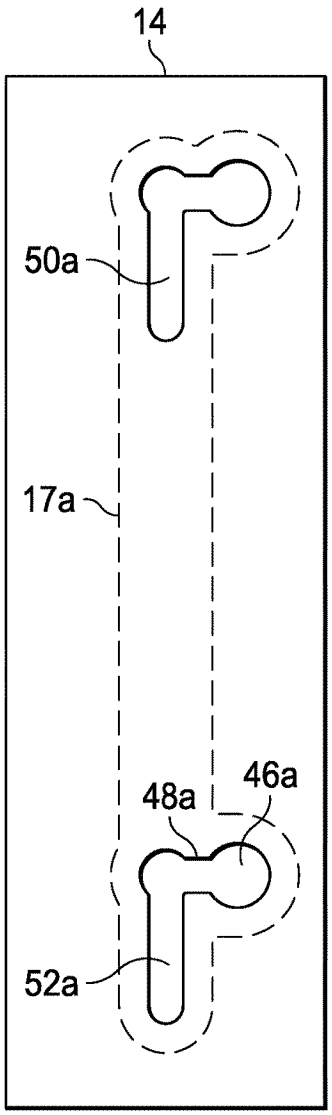

In FIG. 2A to 2C, different configurations of attachment interfaces 17*a*-17*c* that form alternatives to track 17 in FIGS. 1A and 1B. FIG. 2A shows an attachment interface or track 17*a* with a first slot segment 50*a* and a second slot segment 52*a* that moveably mount the first and second ends of the spring member to the support member. The first slot segment 50*a* corresponds to the first slot segment 50 in FIGS. 1A and 1B. The second slot segment 52*a* has the same design as the first slot segment 50*a*. In other words, the second slot segment 52*a* includes an insertion opening 46*a* that is sized to accommodate the head portion of a sliding pin. The insertion opening 46*a* is connected to the slot by a connection portion 48*a*. Since the first and second ends of the spring member are not fixed in place, one or both ends of the spring member can move in response to the deflection of the spring member to absorb substantial levels of impact energy.

FIG. 2B shows an attachment interface or track 17*b* with an attachment section 51*b* and a slot segment 52*b*. The slot segment 52*b* is similar to the slot segments 50*a*, 52*a* in FIG. 2A and allows the second end of the spring member to move along the spring axis S. In contrast, the attachment section 51*b* includes an insertion opening 46*b* that is connected to a hook portion 53*b* that mounts the first end of the spring member to the support member at a fixed position along the spring axis S. Since one end of the spring member is fixed in place, only the end of the spring member mounted to the slot segment 52*b* can move in response to the deflection of the spring member. Thus, the track 17*b* of FIG. 2B is designed to absorb a moderate amount of impact energy, i.e., less impact energy than the track 17*a* of FIG. 2A. Although the track 17*b* is shown with the attachment section 51*b* at the top and the slot segment 52*b* at the bottom, their positions may be reversed.

FIG. 2C shows an attachment interface 17*c* that includes two attachment sections 51*c* that correspond to the attachment section 51*b* in FIG. 2B. Each attachment section 51*c* includes an insertion opening 46*c* that is connected to a hook portion 53*c* that mounts the first end of the spring member to the support member at a fixed position along the spring axis S. Thus the attachment interface 17*c* is configured to releasably engage the first and second ends of the spring member to mount the spring member to the support member, but the ends of the spring member are not moveable relative to the support member 14. Accordingly, the attachment interface 17*c* is designed to absorb the smallest amount of impact energy out of attachment interfaces 17*a*-17*c*. In this implementation, the spring member includes a suitably elastic material that allows the spring member to attach to the support member and deflect upon impact of the load.

In some implementations, the spring member 12 can include a composite material and one or more optic fiber sensors embedded in the composite material. The optic fiber sensors can be used to detect the extent to which the spring member 12 deflects, and thus the load absorbed by the bumper 10. Such information can be processed using machine learning techniques to predict, for example, maintenance intervals.

In the implementation illustrated in FIGS. 1A and 1B, the support member 14 has a rectangular cross section 56, the first and second sliding pins 42, 44 are positioned inside of the cross-section 56 via the slot segments 50, 52. In other implementations, the track does not include a slot or slot segments. For example, the support member 14 can form a U-shaped track, with the rollers 30, 32 received within the U-shaped cross-section. The arc-shaped portion of the spring member 12 can protrude from the opening of the U-shape and the first and second ends 16, 18 can still move apart on deflection in the previously described manner. An implementation with a U-shaped track may not necessarily include first and second sliding pins 42, 44.

Other implementations may not necessarily include rollers 30, 32 that move across the outer surface of the support member 14. For example, the support member 14 can have a circular, elliptical, or hexagonal shape that makes such rollers 30, 32 impractical. In this case, the first and second ends 16, 18 can be connected to a slot or slot segments by sliding pins that are similar to first and second sliding pins 42, 44. Although the first and second sliding pins 42, 44 are relatively small in comparison to the size of the loops 36, the size shown in the drawing is not necessarily representative.

Thus, the resilient bumper of the present disclosure acts as an elastic machine that undergoes deflection under the application of large loads and is designed to regain its original shape once the load is removed. As such, it serves as a shock absorber that reduces the amount of energy transmitted to the structure connected to the bumper by storing most of the impact energy as potential energy upon deflection during loading. The bumper can be installed individually or in series and thus provides a flexible and modular bumper design for different types of structures.

Figure 3:
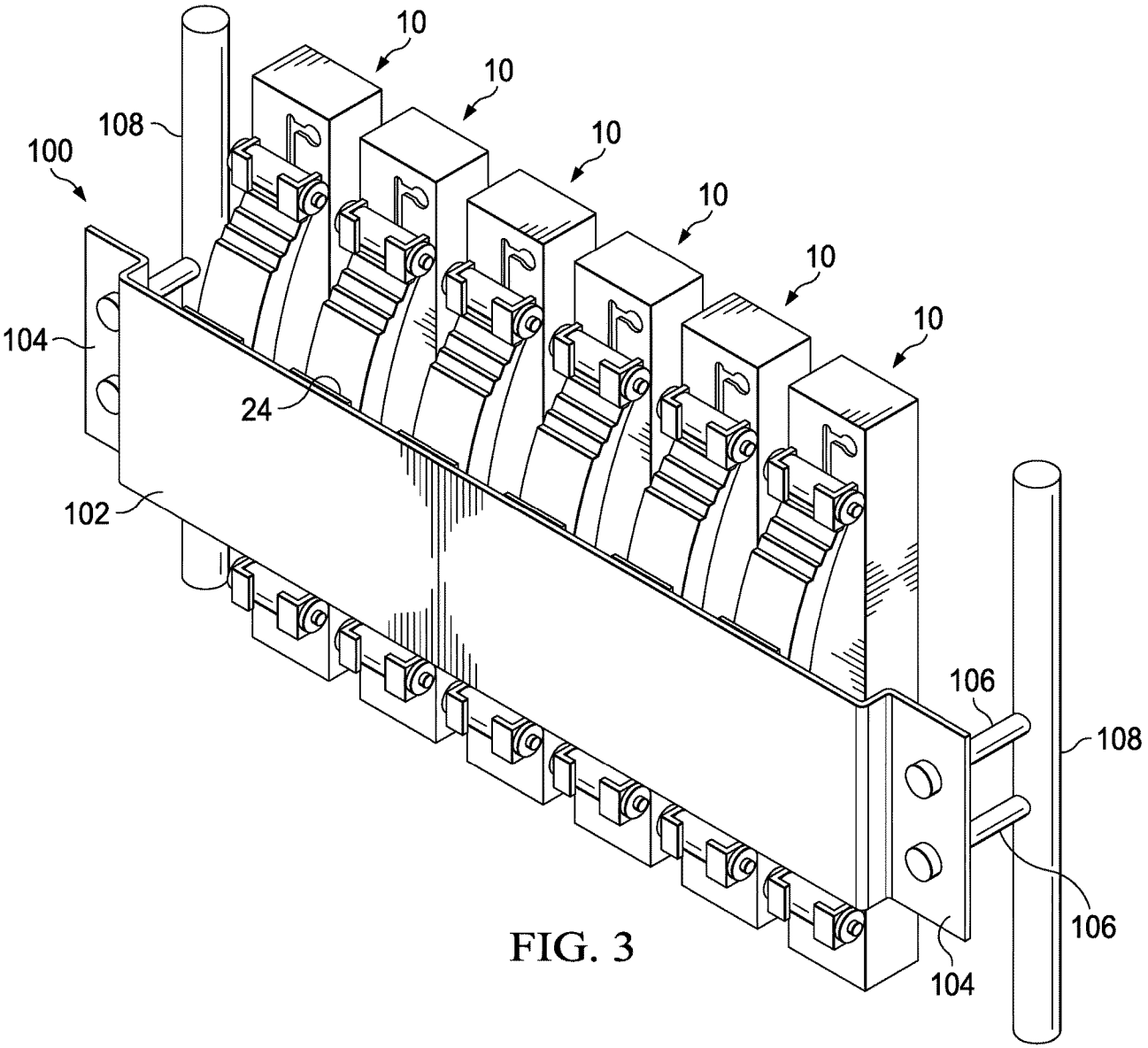
FIG. 3 shows a front perspective view of a plurality of resilient bumpers according to one implementation.

Referring now to FIG. 3, a plurality of resilient bumpers 10 is shown. The bumpers 10 are arranged at the same height and covered by a common load plate 100. More specifically, the load plate 100 includes a plate portion 102 that transfers loads to the impact surface 15 of each resilient bumper 10. In other words, the plate portion 102 forms a common impact surface for the plurality of bumpers 10. For example, a rear surface of the plate portion 102 includes rectangular recesses that each engage a bumper plate 24 of a respective bumper 10. Since the load plate 100 is attached to each of the bumpers 10, the load from a colliding object can be evenly distributed across the bumpers 10. For example, in the illustrated implementation, the plate portion 102 has approximately the same height as and covers the entire bumper plate 24 of each spring member 12. However, the plate portion 102 is not necessarily attached to the individual bumpers 10. In some cases, the plate portion 102 may merely rest upon the spring members 12 of the plurality of bumpers 10 instead of being attached to the impact surfaces of the individual bumpers 10.

The load plate 100 includes two mounting sections 104 for mounting the plate portion 102. For example, each mounting section 104 can be bent away from the plate portion 102 to increase the overall strength of the load plate 100. Each mounting section 104 can be mounted to a pair of rods 106 that are connected to a mounting beam 108. When an object collides with the plate portion 102, the plate portion 102 can transfer force to each spring member 12 via its impact surface and cause the spring member 12 to deflect. At the same time, the mounting sections 104 can be configured to slide along the rods 106 such that the load plate 100 moves with the spring members 12 of the bumpers 10. In other cases, the mounting sections 104 of the plate portion 102 are fixed to the frame. In this case, the plate portion 102 can deflect inward towards the spring members 12.

Figure 4:
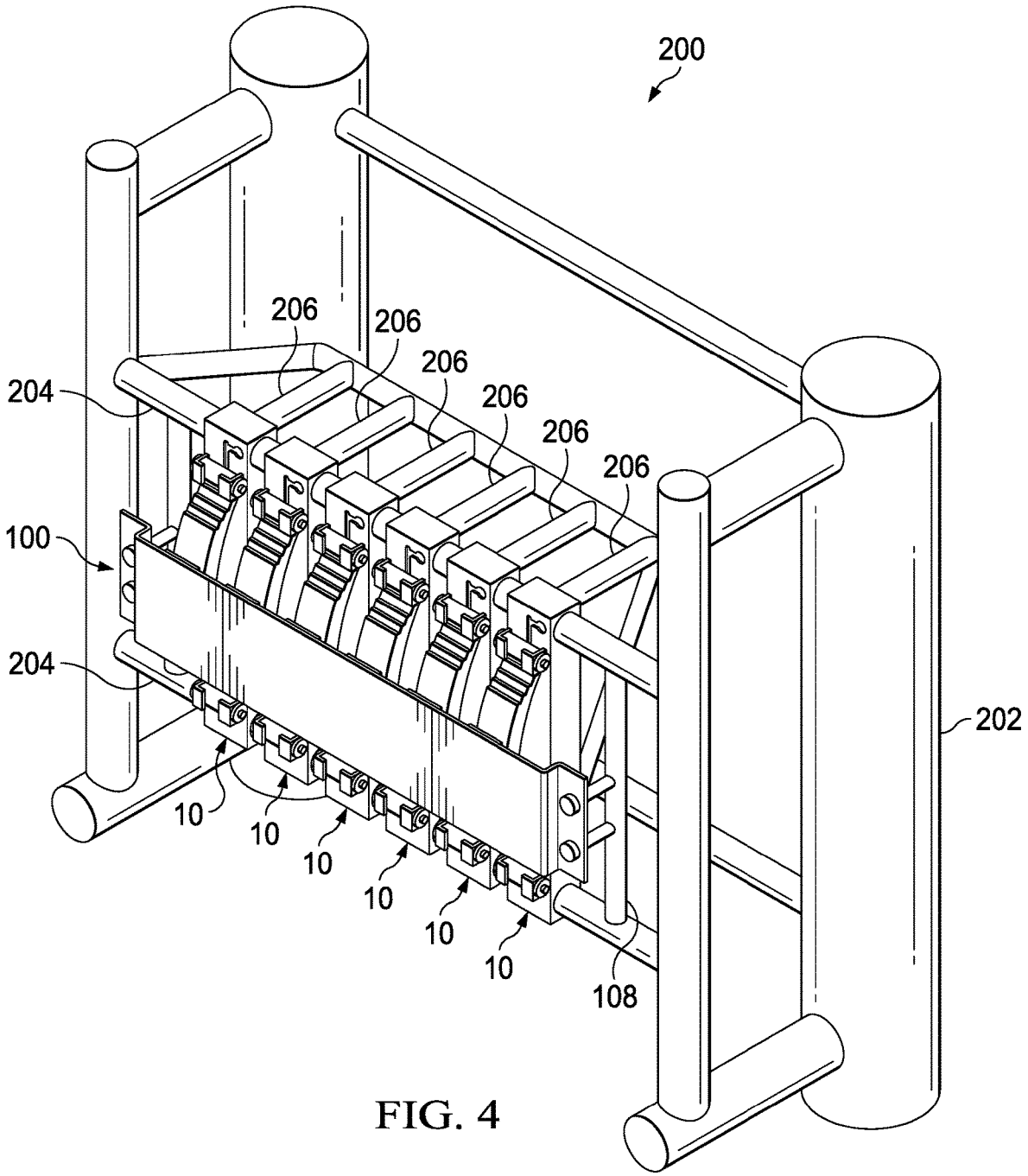
FIG. 4 shows the resilient bumpers of FIG. 3 integrated into a bumper system according to an implementation.

FIG. 4 is a perspective view of a bumper system 200. In general, a bumper system 200 includes a plurality of bumpers 10 and a frame 202 to which the support member of each of the plurality of resilient bumpers is connected. The illustrated implementation of the bumper system 200 includes the optional load plate 100 shown in FIG. 3. The frame 202 can be a freestanding structure, but it can also be integrated into a larger structure, as shown in FIGS. 5A, 5B, 6A, and 6B. For example, the frame 202 can include a pair of cross bars 204 that extend through the respective top and bottom mounting holes 54 in each support member 14. An individual support 206 can be arranged transverse to the cross bar 204 behind each support member 14 to provide further structural integrity. The mounting beams 108 of the load plate 100 can also extend transversely to and between the pair of cross bars 204.

In the illustrated implementation, the frame 202, the support members 14, and the mounting beams 108 can be assembled once to form a permanent structure. The plate portion 102 can be removed and the individual spring members 12 can be replaced. For example, if one of the spring members 12 breaks, the plate portion 102 can be removed and a new spring member 12 can be mounted to the corresponding support member 14 in the previously described manner. After the broken spring member 12 is replaced, the plate portion 102 of the load plate 100 can be reattached to the rods 106 and mounting beams 108 to restore the bumper system 200 to its working condition.

Although the implementations illustrated in FIGS. 3 and 4 include a load plate 100, other implementations of the bumper system 200 can include a plurality of resilient bumpers 10 that are mounted to a frame 202 without a common load plate 100. In some situations, it may be desirable that the spring members 12 deflect individually as opposed to the load being distributed across all of the spring members 12.

Both in implementations with and without a load plate 100, the spring members 12 can include optic fiber sensors that detect the deflection and load applied to the spring members 12. Such information can be collected and aggregated for maintenance purposes or to ensure that the bumper system 200 has a sufficient number of bumpers 10 to absorb the loads that result when foreign objects collide with the bumper system 200.

Figure 5A:
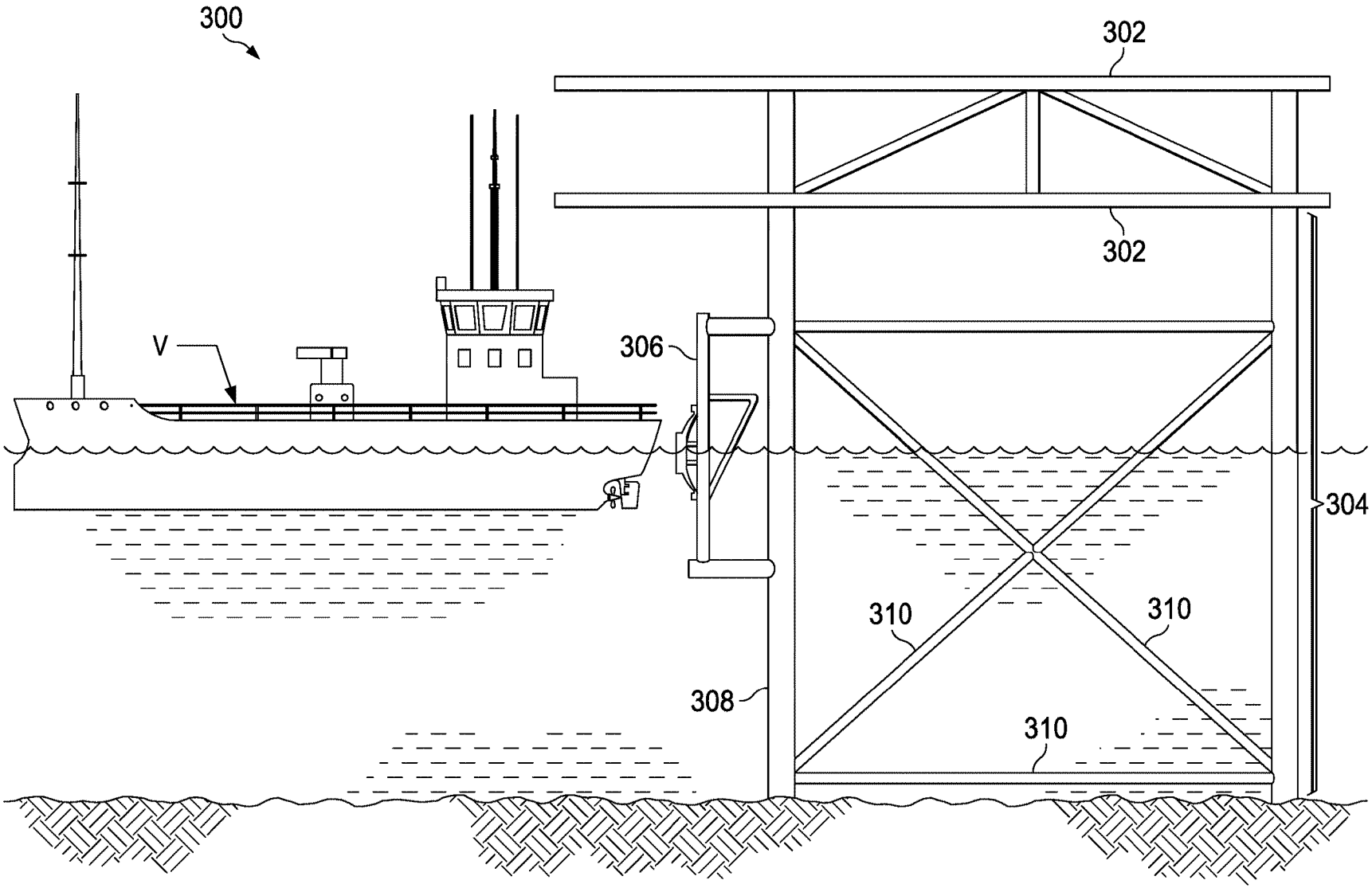
FIG. 5A is a schematic illustration of an offshore platform and an implementation of a bumper system from the side.
Figure 5B:
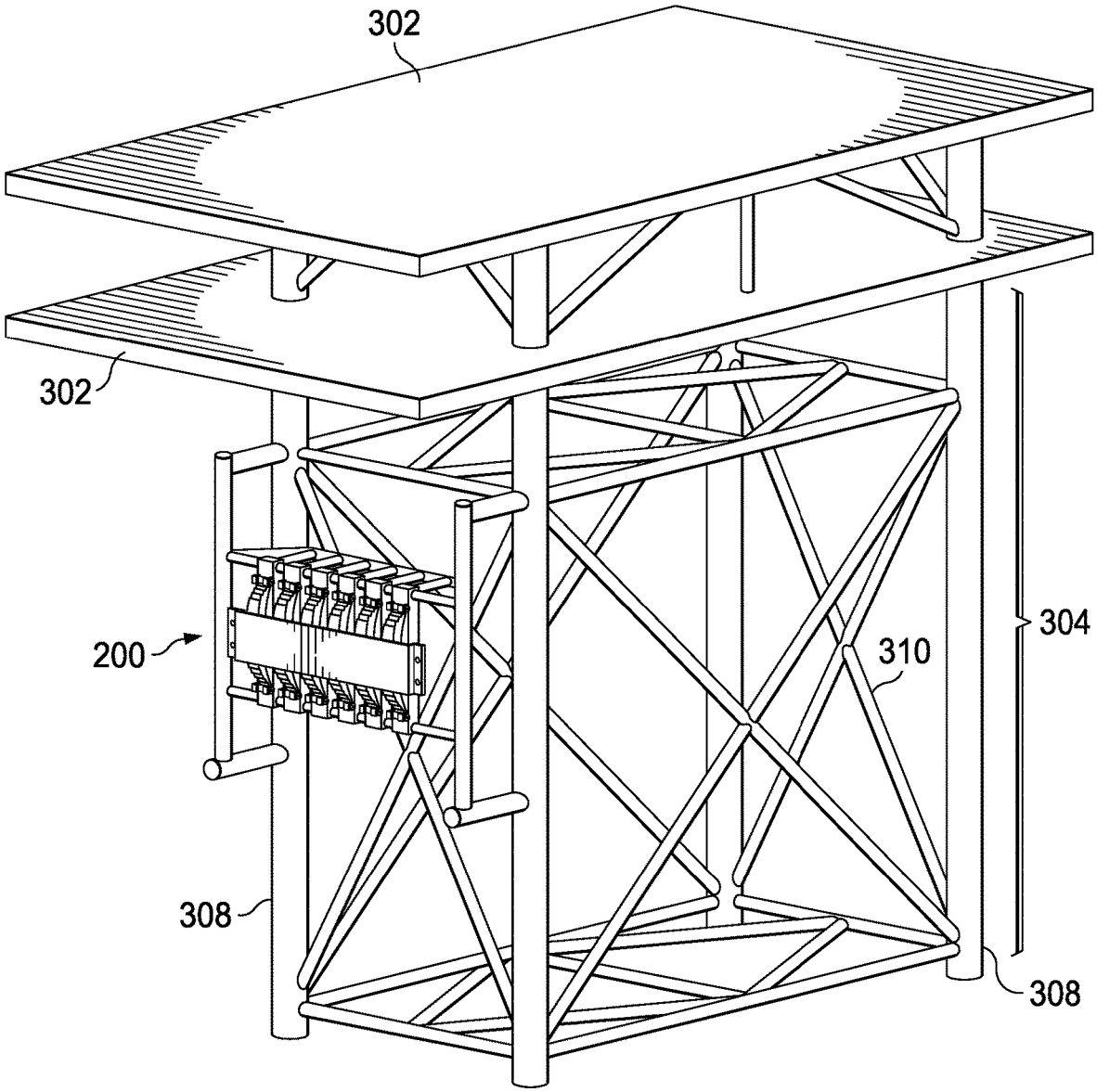
FIG. 5B shows a perspective view of the offshore platform in FIG. 5A.

FIGS. 5A, 5B, 6A, and 6B show two examples of the bumper system 200 in use in a marine setting. More specifically, FIGS. 5A and 5B show an offshore platform 300 that includes one or more decks 302, a support structure 304, and a boat landing 306. The decks 302 are arranged above sea level and support equipment that is omitted from the drawing. The support structure 304 comprises welded steel tubular members that form beams and columns that support the decks 302. In the illustrated example, four columns 308 extend from the seabed to the decks 302 and are connected by several reinforcing beams 310. The boat landing 306 is arranged at sea level and is designed to protect the offshore platform 300 from collision with ships. For this purpose, the boat landing 306 includes a bumper system 200. The bumper system's frame 202 and the platform's support structure 304 can share common components, such as the columns 308. Since the bumper system 200 protects the offshore platform 300 from collisions with ships and other vessels, smaller tubular members can be used to form the support structure 304. In addition to preventing general damage from vessels, the bumper system 200 may even allow a larger type of vessel to land at the boat landing 306 than the offshore platform 300 would otherwise be able to accommodate.

Figure 6A:
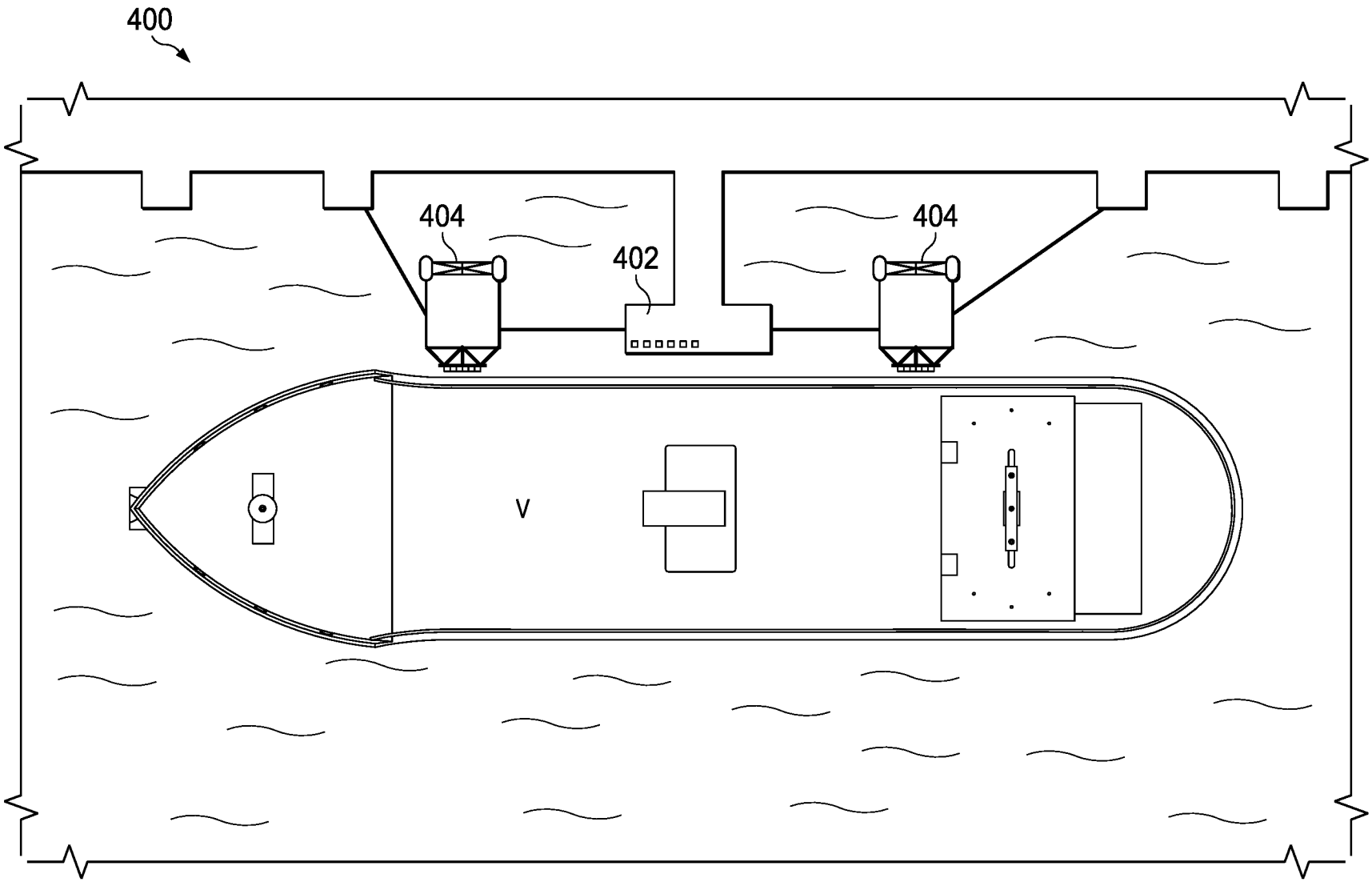
FIG. 6A is a schematic illustration of a marine terminal that includes two breasting dolphins.
Figure 6B:
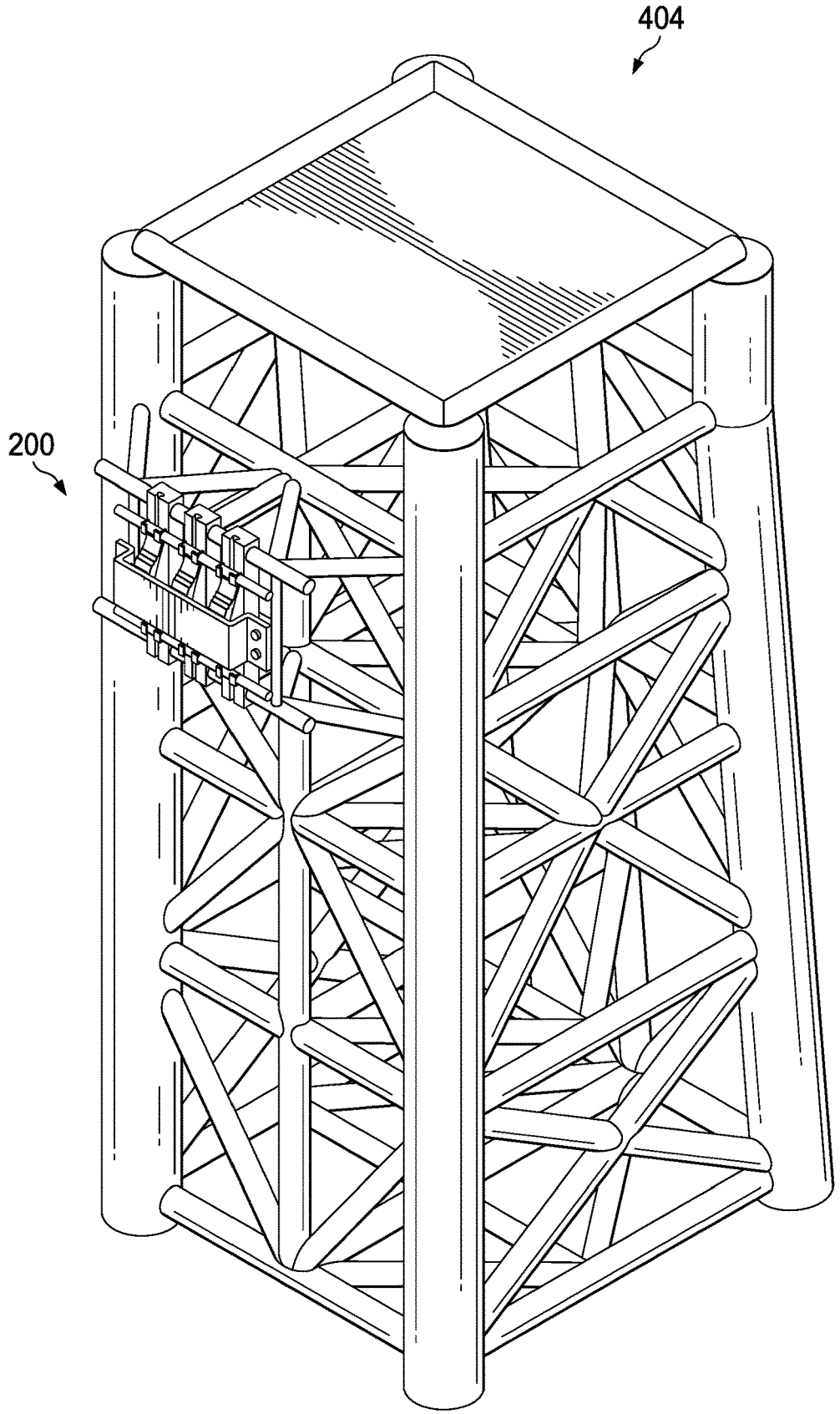
FIG. 6B shows a perspective view of one of the breasting dolphins in FIG. 6A.

FIGS. 6A and 6B show a further implementation in which the bumper system 200 of the present disclosure is incorporated into a marine terminal. A marine terminal 400 can include a pier 402 and one or more breasting dolphins 404. A breasting dolphin is a marine structure for berthing and mooring a vessel V along the pier 402. The purpose of a breasting dolphin 404 is to absorb impact from the vessel V and to prevent the vessel from coming into contact with the pier 402. By absorbing some of the berthing loads, breasting dolphins allow large vessels to berth at much smaller pier structures. Breasting dolphins 404 can also serve as mooring points that prevent the vessel V from moving in a longitudinal direction.

Similarly to the boat landing in FIGS. 5A and 5B, the breasting dolphin 404 comprises a bumper system 200 positioned at sea level, i.e., at the location at which the vessel V is likely to come into contact with the breasting dolphin 404. Unlike the implementations shown in FIGS. 3, 4, 5A, and 5B, the bumper system 200 of FIGS. 6A and 6B only has three resilient bumpers. However, depending on the application, the bumper system 200 for the breasting dolphin 404 can be adapted to include a larger number of resilient bumpers.

In addition to the boat landing and the breasting dolphin shown in FIGS. 5A, 5B, 6A, and 6B, the resilient bumper 10 and the bumper system 200 can also be used in fixed jackets, floating systems, ports, and naval bases, for example. The resilient bumpers and the bumper system of the present disclosure can be flexibly adapted to a specific pier, structure, or vessel and do not depend on a large contact area along the longitudinal length of the vessel.

The above description is presented to enable any person skilled in the art to make and use the disclosed subject matter, and is provided in the context of one or more particular implementations. Various modifications to the disclosed implementations will be readily apparent to those skilled in the art, and the general principles defined in this disclosure may be applied to other implementations and applications without departing from scope of the disclosure. Thus, the present disclosure is not intended to be limited to the described or illustrated implementations, but is to be accorded the widest scope consistent with the principles and features disclosed in this disclosure.

What is claimed is:

1. A resilient bumper, comprising an arc-shaped spring member that extends from a first end to a second end along a spring axis and comprises an impact surface arranged between the first and second ends; and a support member that comprises an attachment interface that extends in parallel to the spring axis of the spring member and is configured to releasably engage the first and second ends of the spring member, wherein the attachment interface comprises a slot formed in a surface of the support member, wherein at least one of the first and second ends of the spring member are moveably mounted to the attachment interface, wherein a deflection of the spring member increases a distance between the first and second ends of the spring member along the spring axis, wherein the first end of the spring member comprises a first pair of rollers rotatably mounted to the first end of the spring member, and the second end of the spring member comprises a second pair of rollers rotatably mounted to the second end of the spring member, wherein the first and second pair of rollers are configured to roll along a surface of the support member as the first and second ends move along the attachment interface.

2. The bumper of claim 1, wherein the spring member comprises a leaf spring comprising a spring steel, a fiber-reinforced material, a resin, a composite material, or a combination thereof.

3. The bumper of claim 1, wherein the spring member comprises a stacked leaf spring that comprises a stack of arc-shaped spring leaves and one or more clamps to clamp the stack of spring leaves.

4. The bumper of claim 3, wherein each spring leaf comprises a spring steel, a fiber-reinforced material, a resin, a composite material, or a combination thereof.

5. The bumper of claim 3, the stacked leaf spring further comprising a flat bumper plate that forms the impact surface, wherein the clamp presses the bumper plate against the stack of spring leaves.

6. The bumper of claim 1, wherein the first end of the spring member comprises a first sliding pin and the second end of the spring member comprises a second sliding pin, wherein the slot is configured to receive a shaft portion of each of the first and second sliding pins, and wherein the first and second sliding pin each comprise a head portion connected to the shaft portion and having an outer diameter larger than a width of an opening of the slot.

7. The bumper of claim 6, wherein the attachment interface comprises one or more insertion openings that are sized to accommodate the head portion of the first and second sliding pins and communicate with the slot.

8. The bumper of claim 7, wherein the one or more insertion openings are offset laterally to the spring axis and connected to the slot by a respective connection portion.

9. The bumper of claim 6, wherein the slot comprises a first slot segment configured to receive the shaft portion of the first sliding pin and a second slot segment configured to receive the shaft portion of the second sliding pin, wherein the first and second slot segments are separate from one another.

10. The bumper of claim 6, wherein the slot comprises a hook portion that supports the first or the second sliding pin at a fixed vertical position along the spring axis.

11. The bumper of claim 1, wherein the first and second pairs of rollers are received within the support member and configured to travel along an inner surface of the support member, wherein the attachment interface comprises an opening through which the spring member extends.

12. The bumper of claim 1, wherein the spring member comprises a composite material and one or more optic fiber sensors embedded in the composite material, wherein the one or more optic fiber sensors are configured to detect a load as the spring member deflects.

13. The bumper of claim 1, wherein the support member includes one or more mounting holes for mounting the support member.

14. A bumper system comprising:

a plurality of resilient bumpers, each resilient bumper comprising:

an arc-shaped spring member that extends from a first end to a second end along a spring axis and comprises an impact surface arranged between the first and second ends, and a support member that comprises a slot formed in a surface of the support member and that extends in parallel to the spring axis of the spring member and is configured to releasably engage the first and second ends of the spring member; and a frame to which the support member of each of the plurality of resilient bumpers is connected, such that the resilient bumpers are aligned along a frame axis substantially transverse to the spring axis of each resilient bumper, wherein at least one of the first and second ends of the spring member are moveably mounted to the slot, wherein a deflection of the spring member increases a distance between the first and second ends of the spring member along the spring axis, wherein the first end of the spring member comprises a first pair of rollers rotatably mounted to the first end of the spring member, and the second end of the spring member comprises a second pair of rollers rotatably mounted to the second end of the spring member, wherein the first and second pair of rollers are configured to roll along a surface of the support member as the first and second ends move along the slot.

15. The bumper system of claim 14, further comprising a load panel that extends along the frame axis and covers the resilient bumpers, wherein each of the spring members of the plurality of resilient bumpers comprises a flat bumper plate configured to engage the load panel.

16. The bumper system of claim 14, wherein each of the spring members comprises a composite material and one or more optic fiber sensors embedded in the composite material, wherein the one or more optic fiber sensors are configured to detect a load as the spring member deflects.

17. A marine structure comprising:

a plurality of resilient bumpers, each resilient bumper comprising an arc-shaped spring member that extends from a first end to a second end along a spring axis and comprises an impact surface arranged between the first and second ends, and a support member that comprises a slot formed in a surface of the support member and that extends in parallel to the spring axis of the spring member and is configured to releasably engage the first and second ends of the spring member; and a frame to which the support member of each of the plurality of resilient bumpers is connected, such that the resilient bumpers are aligned along a frame axis substantially transverse to the spring axis of each resilient bumper, wherein the frame is configured to rest on the seabed, wherein at least one of the first and second ends of the spring member are moveably mounted to the attachment interface, wherein a deflection of the spring member increases a distance between the first and second ends of the spring member along the spring axis, wherein the first end of the spring member comprises a first pair of rollers rotatably mounted to the first end of the spring member, and the second end of the spring member comprises a second pair of rollers rotatably mounted to the second end of the spring member, wherein the first and second pair of rollers are configured to roll along a surface of the support member as the first and second ends move along the attachment interface.

* * * * *